United States Patent [19]

Bustamante

[11] Patent Number: 4,735,707

[45] Date of Patent: Apr. 5, 1988

[54] REMOVING MINERAL MATTER FROM SOLID CARBONACEOUS FUELS

[75] Inventor: Heriberto A. Bustamante, Ashford, England

[73] Assignee: The British Petroleum Company p.l.c., London, England

[21] Appl. No.: 867,025

[22] Filed: May 27, 1986

[30] Foreign Application Priority Data

Jun. 1, 1985 [GB] United Kingdom ..... 8513868

[51] Int. Cl.[4] ..... B03C 1/00

[52] U.S. Cl. ..... 209/5; 209/214; 209/8; 44/15 R

[58] Field of Search ..... 209/5, 8, 213, 214, 209/215; 75/3; 44/1 SR

[56] References Cited

U.S. PATENT DOCUMENTS

| | | | |
|---|---|---|---|
| 2,954,122 | 9/1960 | Colburn | 209/214 |
| 3,926,789 | 12/1975 | Shubert | 209/214 |
| 3,929,627 | 12/1975 | Frangiskos | 209/214 |
| 3,938,966 | 2/1976 | Kindig | 44/1 SR |
| 4,081,251 | 3/1978 | Colli | 44/1 SR |
| 4,081,357 | 3/1978 | Werneke | 210/734 |
| 4,098,584 | 7/1978 | Kindig | 44/1 SR |
| 4,147,614 | 3/1979 | Gambopaulos | 209/8 |
| 4,225,425 | 9/1980 | Price | 209/8 X |
| 4,274,945 | 6/1981 | Goodman et al. | 210/734 |
| 4,282,087 | 8/1981 | Goodman et al. | 210/734 |
| 4,298,169 | 11/1981 | Iwasaki | 209/5 X |
| 4,388,179 | 6/1983 | Lewis | 210/695 |
| 4,508,625 | 4/1985 | Graham | 210/695 |
| 4,569,682 | 11/1986 | Baker | 55/6 |
| 4,643,822 | 2/1987 | Parsonage | 209/5 |

FOREIGN PATENT DOCUMENTS

| | | | |
|---|---|---|---|
| 26700 | 4/1981 | European Pat. Off. . | |
| 127906 | 12/1984 | European Pat. Off. . | |
| 25969 | 3/1978 | Japan | 210/695 |
| WO83/1397 | 4/1983 | PCT Int'l Appl. . | |
| WO84/0471 | 2/1984 | PCT Int'l Appl. . | |
| WO84/4701 | 12/1984 | PCT Int'l Appl. . | |
| 1533876 | 11/1978 | United Kingdom . | |
| 2091135 | 7/1982 | United Kingdom . | |
| 2134416 | 12/1982 | United Kingdom . | |

OTHER PUBLICATIONS

Encyclopedia of Chemical Technology, 3rd Ed., vol. 6, p. 228, "COAL", subheading Mineral Matter in Coal.

"Coal Beneficiation with Magnetic Fluids" by Sladek and Cox, Colorado School of Mines Research Institute (no date).

*Primary Examiner*—Kenneth M. Schor
*Assistant Examiner*—Thomas M. Lithgow
*Attorney, Agent, or Firm*—Morgan & Finnegan

[57] ABSTRACT

Mineral particles are separated from solid carbonaceous fuel by using magnetic separation. A mixture of mineral particles, carbonaceous fuel, ferromagnetic particles and polyacrylamide in water is subjected to magnetic separation to remove a magnetized fraction enriched in mineral water.

8 Claims, No Drawings

REMOVING MINERAL MATTER FROM SOLID CARBONACEOUS FUELS

The present invention relates to the removal of mineral matter from solid carbonaceous fuels. Solid carbonaceous fuels such as coal and lignite when mined frequently contain substantial amounts of non-combustible mineral matter. It is often desirable to beneficiate the solid carbonaceous fuel i.e. to remove some or all of the mineral matter from it.

It is disclosed in International Patent Application WO 84/04701 that mineral matter may be removed from solid carbonaceous fuels by forming a mixture of water, solid carbonaceous fuel particles, mineral particles, ferromagnetic particles and hydrophobic oil and subjecting the mixture to sufficiently high shear to cause flocculation of the solid carbonaceous fuel particles. The flocculated mixture is then subjected to magnetic separation so as to recover a magnetised fraction enriched in solid carbonaceous fuel.

The use of magnetic treatments to beneficiate coal is also discussed by Sladek and Cox in a paper entitled "Coal Beneficiation with Magnetic Fluids" Proc Conf Ind Appln of Magn Sep., Rindge, NH, USA, August 1978. Sladek and Cox disclose the use of kerosine-based magnetic fluids to produce a magnetised coal fraction. The possibility of using aqueous magnetic fluids to remove ash magnetically however is mentioned.

Sladek and Cox use expensive magnetic liquids. Their work on removing ash magnetically did not suggest that the use of magnetic liquids had any significant advantage over magnetic separation without magnetic liquids.

We have now found an improved process for removing mineral matter from solid carbonaceous fuels.

According to the present invention the process for separating mineral particles from solid carbonaceous fuel comprises forming a mixture of water and solid carbonaceous fuel particles, mineral particles, ferromagnetic particles and an effective amount of a polyacrylamide flocculant having a weight average molecular weight above one million, and then subjecting the mixture to a magnetic separation so as to remove a magnetised fraction enriched in mineral matter from non-magnetised material.

The process of the present invention may be applied to a variety of solid carbonaceous fuels, eg for cleaning low, medium and high rank bituminous coals, and steaming coals and for recovering coal from ultrafine reject streams rich in mineral matter.

The particle size of the carbonaceous fuel may for example be 850 micrometers, preferably less than 500 micrometers.

The ferromagnetic particles may for example have a weight mean particle size in the range of 50 micrometers to 0.3 micrometers.

Some writers classify materials into (1) ferromagnetic materials such as iron with a high magnetic susceptibility; (2) paramagnetic materials with relatively low but positive susceptibilities and (3) diamagnetic materials with negative susceptibilities. Other writers divide materials into (a) ferromagnetic materials such as iron, (b) ferrimagnetic materials such as magnetite, (c) paramagnetic materials such as liquid oxygen, and (d) diamagnetic materials such as copper. In this specification "ferromagnetic" includes both (a) ferromagnetic and (b) ferrimagnetic.

The ferromagnetic particles are preferably particles of ferromagnetic metals, eg iron, cobalt, nickel. It is preferred to use ferromagnetic oxides of these elements, and it is particularly preferred to use magnetite. Magnetite is readily available at many coal mines as it is used commercially in dense medium separation processes.

Magnetite particles in the preferred size range for use in the process may be obtained by grinding magnetite ore.

The ferromagnetic particles and the polyacrylamide flocculant may be brought into contact with the carbonaceous fuel simply by mixing them into the aqueous suspension. It is preferred to mix the magnetic particles with the carbonaceous fuel for a short period eg up to 5 minutes, before the polymeric flocculant is added.

Non-ionic, cationic and anionic polyacrylamides may be used.

It is preferred to use polyacrylamides having a weight average molecular weight in the range $15\times10^6$ to $3\times10^6$. Ionic polyacrylamides may have different degrees of ionic character. The degree of ionic character is determined by the degree of hydrolysis of the amide group or degree of copolymerisation with a cationic monomer.

The polymeric flocculant and the magnetic particles are allowed to remain in contact with the carbonaceous fuel and mineral matter for a time sufficient to produce a substantial flocculation of the mineral matter. Thus the mixture may be for example agitated for up to a minute before being fed to the magnetic separation step.

The relative quantities of carbonaceous fuel, mineral matter, magnetic particles and polymeric flocculant brought into contact may vary over a moderately wide range. Thus the quantity of magnetic particles used may vary from 0.25 to 15%, preferably 0.25% to 5% by weight of the solid to be treated. The quantity of polymeric flocculant may for example be 0.002% to 0.1% by weight, preferably 0.005 to 0.2 of wt carbonaceous fuel (including mineral matter).

The concentration of the aqueous suspension to which the process of the present invention is applied may vary for example from 5 to 25% wt/wt.

The mixture is then subjected to magnetic separation to remove the flocculated mineral matter particles. Methods and apparatus for carrying out magnetic separations are well-known to those skilled in the art.

The process of the present invention does not require any special treatment of the ferromagnetic particles to obtain the best results. Because the magnetic particles are linked to the mineral matter rather than to the coal, the magnetic particles do not contribute to the ash content of the separated coal. The process is capable of treating a wide range of particle sizes which would either be too fine for cleaning by dense medium flotation or too coarse for cleaning by froth flotation. Coal when exposed to air can become oxidised or weathered, which can adversely affect its suitability for treatment with processes in which coal rather than mineral matter is removed magnetically by the use of magnetic particles and oil.

The invention will now be illustrated by reference the following experiments in which numbered examples are examples of the invention and experiments identified by letters are comparative tests not according to the invention.

The same magnetite were used in all the experiments. This was prepared by grinding the magnetite up to a weight mean particle size of 80% by weight below 38 micrometers.

In all the experiments below an aqueous slurry was prepared containing about 9.0% of the carbonaceous solid/mineral matter mixture to be treated. Magnetite was added to the slurry which was stirred for a short period (not more than 5 minutes). The polymeric flocculant, if used, was then added and the slurry stirred for one minute before being subjected to the magnetic separation step.

In all the experiments below except where otherwise indicated the same feed coal was used containing 25.1% weight of ash. The particle size of the coal was 90% wt below 500 micrometers and 45% below 63 micrometers.

COMPARTIVE TEST A

This is a comparative example carried out without any polymer being added. The quantity of magnetite used and the results obtained are given in the Table.

EXAMPLES 1-4

These are examples according to the invention using various polyacrylamide additives. Details are given in the Table.

EXAMPLE 5

An ultrafine mineral matter reject stream containing 44% coal and 56% free minerals was treated with 1 wt% solids magnetite and 250 mg of anionic polyacrylamide/kg of solids and fed to a magnetic separator. The yield of coal in the non-magnetic fraction was 50% with 12 wt% ash.

EXAMPLE 6

The flotation concentrate of a coal which contained 21 wt% ash was treated with 1 wt% magnetite and 50 mg of anionic polyacrylamide/kg of solids gave a coal yield of 50% with 16 wt% ash.

EXAMPLE 7

The oversize fraction of a −200 micrometers cycloned coal containing 24 wt% ash was treated with 1 wt% magnetite and 140 mg of non-ionic polyacrylamide/kg of solids. The yield of the coal in the non-magnetic fraction was 50% with 17 wt% ash.

EXAMPLE 8

The oversize fraction of a −1 mm cycloned coal containing 26 wt% ash was treated with 1 wt% of magnetite and 160 mg of non-ionic polyacrylamide/kg of solids gave a coal yield of 65% with 15 wt% ash.

EXAMPLE 9

This was carried out as in Examples 1-4 but using a cationic polyacrylamide.

Comparative Tests B and C

These are comparative tests carried out with differing quantities of a 100% cationic polyacrylamide having an average molecular weight of less than one million.

Comparative Tests D to J

These are comparative experiments carried out with various polymeric additives. The additives and the conditions used, together with the results obtained, are given in the Tables.

TABLE

| Ex. | Polymer | M.W. × $10^6$ | Ionic character | Polymer quantity % wt feed | Magnetite quantity % wt feed | Coal yield % wt feed | Coal Ash Content % wt |
|---|---|---|---|---|---|---|---|
| A | None | — | — | — | 5 | 90 | 23 |
| 1 | Polyacrylamide | 13 | 49% A | 0.01 | 5 | 41 | 14 |
| 2 | " | 11 | 35% A | 0.01 | 5 | 39 | 12.1 |
| 3 | " | 15 | 9% A | 0.005 | 5 | 52 | 16.3 |
| 4 | " | 15 | 9% A | 0.0125 | 5 | 26 | 13.3 |
| 5 | " | 6 | 30% A | 0.025 | 1 | 50 | 12 |
| 6 | " | 6 | 30% A | 0.005 | 1 | 50 | 16 |
| 7 | " | 9 | N | 0.014 | 1 | 50 | 17 |
| 8 | " | 9 | N | 0.016 | 1 | 65 | 15 |
| 9 | " | 4 | 63% C | 0.023 | 1 | 47 | 17 |
| B | " | 1 | 100% C | 0.01 | 5 | 84 | 22.5 |
| C | " | 1 | 100% C | 0.05 | 5 | 85 | 22.0 |
| D | Dextran | 2 | N | 0.05 | 5 | 93 | 23.8 |
| E | Carboxymethylcellulose | — | A | 0.05 | 5 | 94 | 24 |
| F | Polyvinylpyrrolidone | 4 | N | 0.05 | 5 | 92 | 22.6 |
| G | Polyoxyethylene | 6 | " | 0.05 | 5 | 89 | 23.2 |
| H | Starch (soluble) | | — | 0.05 | 5 | 90 | 22.7 |
| I | Polyvinylalcohol | 0.1 | N | 0.1 | 5 | 86 | 20.3 |
| J | Polystyrene sulphonic acid | | A | 0.1 | 5 | 87 | 20.2 |

A = anionic
N = non-ionic
C = cationic

EXAMPLE 10

An experiment was carried out as in Example 1, except that the coal used was the oversize function of −1 mm cycloned coal containing 25% weight of ash. This was treated with 1% wt magnetite 0.02% cationic polyacrylamide (24% cationic, MW $7\times10^6$) giving a coal yield of 41% wt with 15.3% wt ash.

EXAMPLE 11

An experiment was carried out as in Example 1 using the same coal as in Example 10. This was treated with 1% wt magnetite, 0.05% wt cationic polyacrylamide (26% cationic, MW $2.4\times10^6$) giving a coal yield of 61 wt% with 17.6% wt ash.

I claim:

1. The process for separating mineral particles from solid carbonaceous fuel comprises forming a mixture of water and solid carbonaceous fuel particles, mineral particles, ferromagnetic particles and an amount of polyacrylamide flocculant effective to flocculate said mineral particles having an average molecular weight above one million, allowing the flocculant and magnetic particles to remain in contact with said carbonaceous fuel and mineral particles for a time sufficient to produce substantial flocculation of the mineral particles, and then subjecting the mixture to a magnetic separation so as to move a magnetised fraction enriched in mineral matter of said mineral particles from non-magnetised material enriched in carbonaceous fuel.

2. The process according to claim 1 wherein the polyacrylamide has an average molecular weight in the range $3\times10^6$ to $20\times10^6$.

3. A process according to claim 2 wherein the average molecular weight of the polyacrylamide is in the range $4\times10^6$ to $15\times10^6$.

4. A process according to claim 3 wherein the polyacrylamide is an anionic compound having an ionic character in the range 20 to 40%.

5. A process according to claim 1 wherein the quantity of polyacrylamide is in the range 0.002% to 0.1% by weight of the solid carbonaceous fuel including mineral matter.

6. A process according to claim 1 wherein the ferromagnetic particles have a particle size in the range 0.3 to 50 micrometers.

7. A process according to claim 6 wherein the ferromagnetic particles are particles of magnetite.

8. A process according to claim 1 wherein the quantity of ferromagnetic particles is in the range 0.25% to 10% by weight of the carbonaceous fuel (including mineral matter) to be treated.

* * * * *